US010836606B2

(12) United States Patent
Helenius

(10) Patent No.: US 10,836,606 B2
(45) Date of Patent: Nov. 17, 2020

(54) METHOD, ARRANGEMENT FOR MONITORING CONDITION OF ELEVATOR ROPE AND ELEVATOR INCLUDING SUCH ARRANGEMENT

(71) Applicant: KONE Corporation, Helsinki (FI)

(72) Inventor: Juha Helenius, Vantaa (FI)

(73) Assignee: KONE CORPORATION, Helsinki (FI)

( * ) Notice: Subject to any disclaimer, the term of this patent is extended or adjusted under 35 U.S.C. 154(b) by 519 days.

(21) Appl. No.: 15/204,356

(22) Filed: Jul. 7, 2016

(65) Prior Publication Data

US 2017/0057788 A1 Mar. 2, 2017

(30) Foreign Application Priority Data

Aug. 31, 2015 (EP) ..... 15183150

(51) Int. Cl.

| | |
|---|---|
| ***B66B 7/12*** | (2006.01) |
| ***B66B 7/06*** | (2006.01) |
| ***B66B 1/30*** | (2006.01) |
| ***B66B 5/00*** | (2006.01) |

(52) U.S. Cl.

CPC ..... *B66B 7/1215* (2013.01); *B66B 1/30* (2013.01); *B66B 5/0025* (2013.01); *B66B 5/0031* (2013.01); *B66B 7/062* (2013.01); *B66B 7/1238* (2013.01)

(58) Field of Classification Search

USPC ..... 187/393

See application file for complete search history.

(56) References Cited

U.S. PATENT DOCUMENTS

| | | | | |
|---|---|---|---|---|
| 4,936,136 | A * | 6/1990 | Vanhala | B66B 5/0025 73/158 |
| 6,868,661 | B2 * | 3/2005 | Aulanko | B66B 11/008 57/232 |
| 9,731,939 | B2 * | 8/2017 | Sun | B66B 7/1223 |
| 2002/0104715 | A1 | 8/2002 | Zaharia et al. | |
| 2003/0111298 | A1 | 6/2003 | Logan et al. | |
| 2006/0243150 | A1 * | 11/2006 | Landrieve | F16H 7/1281 101/494 |

(Continued)

FOREIGN PATENT DOCUMENTS

| | | |
|---|---|---|
| EP | 2 749 519 A1 | 7/2014 |

*Primary Examiner* — Christopher Uhlir

(74) *Attorney, Agent, or Firm* — Birch, Stewart, Kolasch & Birch, LLP.

(57) ABSTRACT

A method for monitoring a condition of a belt-shaped rope of an elevator, which rope is connected with one or more elevator units of an elevator, includes monitoring lateral positions of successive rope locations, which rope locations pass during use of the elevator via a monitoring zone located in proximity of a crowned rope wheel around which the belt-shaped rope is arranged to turn; gathering lateral position data of the belt-shaped rope, which lateral position data indicates lateral positions of several successive rope locations of the rope at the monitoring zone; analyzing the lateral position data; detecting characteristics in the lateral position data indicating damaged rope; and triggering one or more predefined actions if characteristics indicating damaged rope are detected. An arrangement and an elevator, which implement the method, are also disclosed.

20 Claims, 4 Drawing Sheets

(56) References Cited

U.S. PATENT DOCUMENTS

| | | | | |
|---|---|---|---|---|
| 2011/0172932 | A1* | 7/2011 | Bachmann | B66B 7/1215 702/34 |
| 2013/0048432 | A1* | 2/2013 | Alasentie | B66B 7/062 187/251 |
| 2013/0126737 | A1 | 5/2013 | Husmann et al. | |
| 2014/0182975 | A1 | 7/2014 | Ikonen et al. | |
| 2015/0239708 | A1* | 8/2015 | Palazzola | B66B 5/0025 187/254 |

* cited by examiner

METHOD, ARRANGEMENT FOR MONITORING CONDITION OF ELEVATOR ROPE AND ELEVATOR INCLUDING SUCH ARRANGEMENT

FIELD OF THE INVENTION

The invention relates to a method for monitoring condition of a belt-shaped rope of an elevator, and to an arrangement for monitoring condition of a belt-shaped rope of an elevator and an elevator. Said elevator is particularly an elevator for transporting passengers and/or goods.

BACKGROUND OF THE INVENTION

Hoisting ropes typically include one or several load bearing members that are elongated in the longitudinal direction of the rope and each form a structure that continues unbroken throughout the length of the rope. Load bearing members are the members of the rope which are able to bear together the load exerted on the rope in its longitudinal direction. The load, such as a weight suspended by the rope, causes tension on the load bearing member in the longitudinal direction of the rope, which tension can be transmitted by the load bearing member in question all the way from one end of the rope to the other end of the rope. Ropes may further comprise non-bearing components, such as an elastic coating, which cannot transmit tension in the above described way.

The conventional elevator ropes are round in cross section and made from several cords made of steel wires, which cords have been twisted together. In prior art, also belt-like hoisting ropes have been suggested. In such hoisting ropes, the load bearing members can be embedded in a polymer coating, such as rubber or polyurethane coating, forming the surface of the hoisting rope. In the belt-shaped solutions, the load bearing members are most commonly cords made of steel wires twisted together. Furthermore, such solutions exist where said load bearing members are in the form of elongated composite members made of composite material comprising reinforcing fibers in polymer matrix.

For passenger safety it's essential that the condition of elevator suspension and compensation ropes can be monitored reliably. In addition, so as to minimize elevator downtime, it's preferred that poor rope condition can be detected early so that corrective actions (ordering of replacement ropes etc.) can be taken on time. The traditional method for rope condition monitoring of steel wire ropes is visual detection of wire breaks. However, this method cannot be effectively utilized with all ropes. An alternative solution has been proposed in US2014182975A1 wherein condition monitoring is performed by monitoring electrical parameters, and in particular resistance, of the fiber reinforced load bearing members. For this type of condition monitoring, the load bearing members are to be electrically conductive and connected electrically to a source of electricity. This system is simple, efficient and cost effective but has some drawbacks, such as a limited ability to detect local (<1 m) damages in a long rope (>350 m) and inability to detect certain failure modes. Even a local damage can considerably weaken rope breaking load. Furthermore, the prior systems have not been feasible to be modified to automatically locate the specific location of the rope damage. It's a time-consuming task to manually search for the damaged area in a long elevator rope.

BRIEF DESCRIPTION OF THE INVENTION

The object of the invention is to introduce an improved method for monitoring condition of a belt-shaped rope of an elevator, an improved elevator arrangement and an improved elevator for monitoring condition of a belt-shaped rope as well as an elevator implementing the same. An object is particularly to introduce a solution for condition monitoring in a nondestructive manner, wherein many of the drawbacks of the aforementioned current condition monitoring systems and/or drawbacks mentioned or implied later in the description, are eliminated. The solution is primarily intended for detecting and locating rope damages that have originated in elevator use. The method can be used in an elevator independently or in parallel with some other rope condition monitoring method. An object is furthermore to introduce a solution which is suitable inter alia for being used to efficiently monitor ropes having load bearing members made of fiber-reinforced composite material.

It is brought forward a new method for monitoring condition of a belt-shaped rope of an elevator, which rope is connected with one or more elevator units, which are moveable in a hoistway. The method comprises monitoring during use of the elevator lateral positions of successive rope locations of a belt-shaped rope which rope locations pass during use of the elevator via a monitoring zone located in proximity of a crowned rope wheel around which the belt-shaped rope is arranged to turn, in particular resting against a crowned circumferential surface area thereof; gathering lateral position data of the belt-shaped rope, which lateral position data indicates lateral positions of several successive rope locations of the rope at the monitoring zone, e.g. based on detection(s) directed on the rope location in question when the rope location in question was at the monitoring zone; and analyzing the lateral position data; and detecting characteristics in the lateral position data indicating damaged rope; and triggering one or more predefined actions if characteristics indicating damaged rope are detected. During said elevator use, the elevator car is moved such that rope runs via the monitoring zone. With this method, one or more of the above mentioned advantages and/or objectives are achieved. Possible damages in the rope can be detected and reacted to in a swift and appropriate manner. Thus, it is provided a reliable and safe solution. Preferable further features are introduced in the following, which further features can be combined with the method individually or in any combination.

In a preferred embodiment, said monitoring comprises detecting lateral positions of several successive rope locations of the rope, which pass during use of the elevator via the monitoring zone. Said detecting is preferably performed with one or more detectors.

In a preferred embodiment, said detecting comprises measuring the lateral positions.

In a preferred embodiment, said gathering comprises storing lateral positions detected in said monitoring.

In a preferred embodiment, the one or more actions comprises indicating in which location(s) of the rope characteristics in the lateral position data indicating damaged rope were detected.

In a preferred embodiment, the one or more predefined actions include one or more of the following: stopping the elevator; preventing further starts of the elevator; sending an alarm signal; sending a signal containing rope condition information; sending a signal indicating that service is needed; inspecting further the location(s) of the rope in which characteristics in the lateral position data indicating damaged rope were detected, said inspecting including preferably inspecting by a service person; replacing the rope with a new rope.

In a preferred embodiment, said characteristics in the lateral position data indicating damaged rope include a predefined deviation in lateral position of the belt-shaped rope.

In a preferred embodiment, said deviation is a peak-like deviation. Said peak-like deviation can be a deviation of the lateral position of a location from the lateral positions of other locations in a predefined manner, such as by an amount exceeding a limit, said other locations preferably including one or more locations on opposite sides of the location in question.

In a preferred embodiment, said deviation is a deviation of the lateral position of a location from the lateral position(s) detected for the same location earlier.

In a preferred embodiment, the lateral position data presents the lateral positions of said rope locations as an amount of displacement from a specific (default) position.

In a preferred embodiment, said lateral position data is in a curve form.

In a preferred embodiment, said lateral position data indicates the lateral position as function of rope location. The rope location is then preferably presented in units of length such as meters or feet.

In a preferred embodiment, said lateral position data is gathered during single elevator run. Said lateral position data can be gathered during each elevator run, for example.

In a preferred embodiment, said lateral position data is gathered during plurality of (e.g. two or more) elevator runs. Then, it is preferable that the characteristics include that the aforementioned predefined deviation is consistently detected in the same rope location.

In a preferred embodiment, said analyzing the lateral position data and/or said detecting characteristics in the lateral position data indicating damaged rope is performed at least partly by one or more electronic processors, such as one or more microprocessors.

In a preferred embodiment, said method is performed periodically (e.g. after every 100 000 starts).

In a preferred embodiment, the rope comprises one or more load bearing members. The one or more load bearing members are particularly such that they extend parallel to the longitudinal direction of the rope unbroken throughout the length of the rope.

In a preferred embodiment, the rope comprises a coating forming the outer surface of the rope. The rope preferably rests against the crowned circumferential surface area of the crowned rope wheel via the coating. The one or more load bearing members are preferably embedded in the coating. The coating is preferably made of polymer material. Failures in adhesion, such as adhesion produced by chemical bonding, between the coating and the load bearing member(s), in particular between the load bearing members made of composite described, cannot be detected with the existing condition monitoring solutions. The strength of this adhesion is essential for the performance of the rope, and in particular for internal cohesion and good traction, for instance. For this reason, the condition monitoring by the solution that uses, the lateral position data, as described, is particularly advantageous with this kind of rope.

In a preferred embodiment, the rope comprises one or more load bearing members made of composite material comprising reinforcing fibers embedded in polymer matrix, said reinforcing fibers preferably being carbon fibers. This type of material makes the rope relatively brittle and difficult to determine its condition by existing solution. For this reason, the condition monitoring by using the lateral position data is particularly advantageous with this kind of rope. The internal structure of the rope is different from conventional steel wire ropes, due to which it is subject to different failure modes. It is possible to use the condition monitoring solution to detect discontinuities, but also different failures such as delamination of fibres and matrix. Although delamination doesn't necessarily decrease rope tensile strength, it can be a starting point for fatigue failure. Thus, it is preferably among the damages detected by condition monitoring. The one or more load bearing members are particularly such that they extend parallel to the longitudinal direction of the rope unbroken throughout the length of the rope.

In a preferred embodiment, the reinforcing fibers of each load bearing member are substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together at least a 25-75% proportion of the cross-section of the rope, most preferably over 50% proportion of the cross-section of the rope.

In a preferred embodiment, the reinforcing fibers are not twisted together. Instead, it is preferable that substantially all the reinforcing fibers of each load bearing member are parallel with the longitudinal direction of the load bearing member. Thereby the fibers are also parallel with the longitudinal direction of the rope as each load bearing member is oriented parallel with the longitudinal direction of the rope. This facilitates further the longitudinal stiffness of the rope.

In a preferred embodiment, the width/thickness ratio of the rope is more than two, preferably more than 4.

In a preferred embodiment, the rope comprises plurality of said load bearing members adjacent each other in width direction of the rope In a preferred embodiment, each said load bearing member is a solid elongated rod-like one-piece structure.

In a preferred embodiment, the crowned circumferential surface area has a convex shape having a peak against which the rope is arranged to rest.

In a preferred embodiment, said elevator units comprise at least an elevator car, preferably an elevator car and a counterweight interconnected with the rope.

In a preferred embodiment, both the crowned circumferential surface area a as well as the side of the rope resting against it are smooth, at least to a degree that lateral movement of the rope along the crowned circumference area a of the rope wheel is enabled.

In a preferred embodiment, the rope section extending between the counterweight and the drive wheel is arranged to turn around the crowned wheel.

In a preferred embodiment, when monitoring rope condition, rope running direction is such that the tension in the rope entering the crowned rope wheel is independent of car load. This eliminates possible effect of car load on the rope lateral position.

In a preferred embodiment, the free rope length before the crowned rope wheel is at least 2 meters, which is to ensure free lateral movement.

In a preferred embodiment, the contact length between the rope and the crowned rope wheel is preferably at least 110 mm, which ensures that crowning works properly.

In a preferred embodiment, the crowned rope wheel is a stationary rope wheel, i.e. not mounted on the car or counterweight.

It is also brought forward a new arrangement for monitoring condition of a belt-shaped rope of an elevator, which rope is connected with one or more elevator units of an elevator which are moveable in a hoistway. The arrangement comprises a rotatable crowned rope wheel around which the belt-shaped rope is arranged to turn in particular resting against a crowned circumferential surface area thereof. The arrangement comprises a rope condition monitoring equipment; wherein the rope condition monitoring equipment is configured to monitor during use of the elevator lateral positions of successive rope locations of a belt-shaped rope which rope locations pass during use of the elevator via a monitoring zone located in proximity of the crowned rope wheel; and to gather lateral position data of the belt-shaped rope, which lateral position data indicates lateral positions of several successive rope locations of the rope at the monitoring zone, e.g. based on detection(s) performed for the rope location in question when the rope location in question was at the monitoring zone; and to analyze the lateral position data; and to detect characteristics in the lateral position data indicating damaged rope; and to trigger one or more actions if characteristics indicating damaged rope are detected. Preferable further features have been introduced in the above as well as in the following, which further features can be combined with the arrangement individually or in any combination.

In a preferred embodiment, the rope condition monitoring equipment comprises one or more detectors detecting lateral position of a rope location in the monitoring zone.

In a preferred embodiment, the monitoring zone is located within less than 2 meters distance, most preferably within less than 1 meters distance, as measured along the rope, from the crowned rope wheel.

In a preferred embodiment, the one or more detectors comprises one or more contactless sensing devices, such as a light curtain or a camera. The one or more contactless sensing devices may then comprise an optical sensing device.

It also is brought forward a new elevator comprising a hoistway, one or more elevator units moveable in the hoistway, and at least one belt-shaped rope connected with the one or more elevator units, wherein the elevator comprises an arrangement for monitoring condition of the belt-shaped rope, which arrangement is as defined anywhere above.

In a preferred embodiment, the elevator comprises means for automatically moving the one or more elevator units.

The elevator is preferably such that the car thereof is arranged to serve two or more landings. The elevator preferably controls movement of the car in response to signals from user interfaces located at landing(s) and/or inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
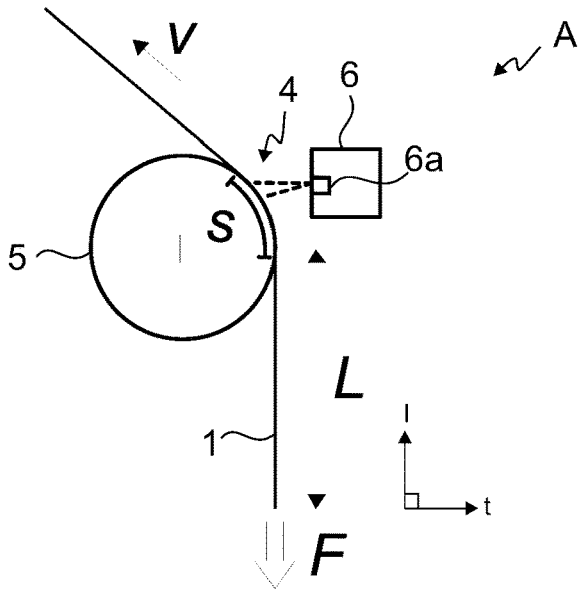
FIG. 1 illustrates an arrangement for monitoring condition of a belt-shaped rope of an elevator implementing a method according to an embodiment as viewed in axial direction of the crowned rope wheel.

FIG. 1 illustrates an arrangement A for monitoring condition of a belt-shaped rope 1 of an elevator, which rope 1 is connected with one or more elevator units (not showed) of an elevator which are moveable in a hoistway of the elevator. The elevator units preferably include at least an elevator car, but preferably also a counterweight. The arrangement A implements a method for monitoring condition of a belt-shaped rope 1 of an elevator. During elevator use, the elevator car is moved such that rope 1 runs via the monitoring zone 4 located in proximity of a crowned rope wheel 5 around which the belt-shaped rope 1 is arranged to turn, in particular resting against a crowned circumferential surface area a thereof. Thereby, during elevator use successive rope locations of the rope 1 pass via the monitoring zone 4. In the method, during use of the elevator lateral positions, i.e. positions particularly in width direction w of the rope 1, of successive rope locations of a belt-shaped rope 1 are monitored, which rope locations pass during use of the elevator via the monitoring zone 4. The size and general nature of the monitoring zone 4 depends on the type of the monitoring means used for said monitoring. In the method, furthermore lateral position data D of the belt-shaped rope 1 is gathered, which lateral position data indicates lateral positions of several successive rope locations of the rope 1 based on detection(s) performed for the rope location in question when the rope location in question was at the monitoring zone 4, and the lateral position data D is analyzed. Furthermore, characteristics in the lateral position data indicating damaged rope 1 are detected. If characteristics indicating damaged rope are detected, one or more predefined actions are triggered. By these measures, possible damages in the rope 1 can be detected and reacted to in a swift and appropriate manner.

Figure 2:
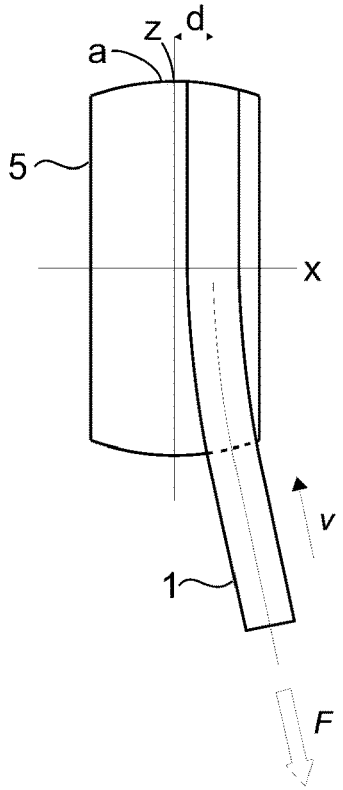
FIG. 2 illustrates the rope and the crowned rope wheel of FIG. 1 as viewed in radial direction of the crowned rope wheel.
Figure 3:
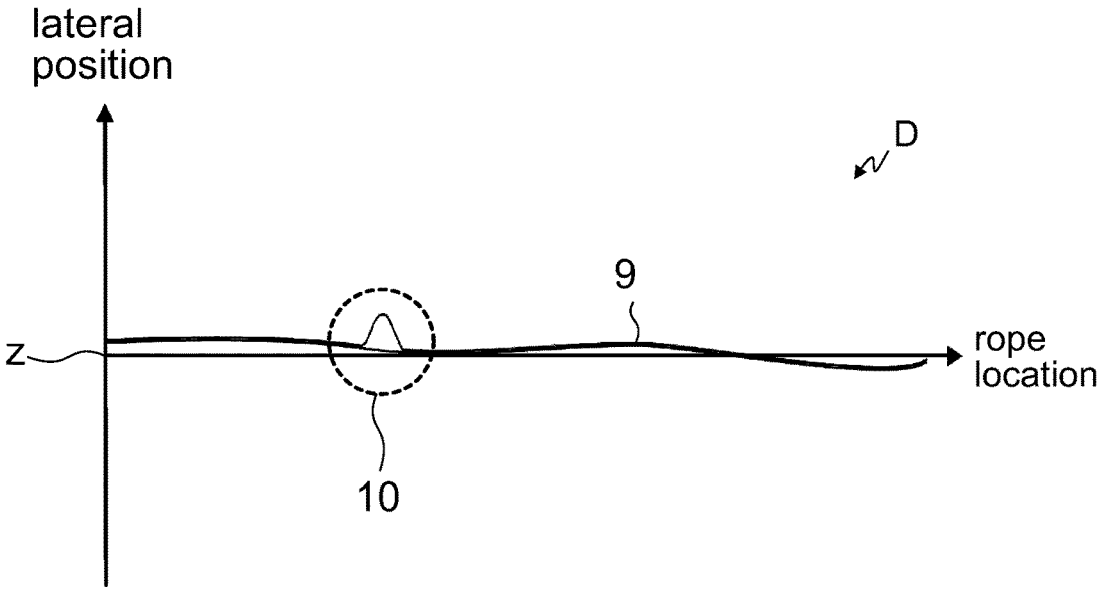
FIG. 3 illustrates an embodiment of the lateral position data.

As mentioned, the belt 1 is arranged to turn around a crowned rope wheel (also known as cambered), in particular resting against a crowned circumferential surface area a thereof. The crowned circumferential surface area a has a convex shape against the peak of which the rope 1 is arranged to rest. When running over a crowned rope wheel 5, the belt 1 tends to move laterally to its equilibrium position z (FIGS. 2 and 3). According to the laws of solid mechanics, the prevailing equilibrium position is determined by the stress distribution inside the belt 1. In addition to advantage of being correctly positioned due to the guiding effect, the phenomenon related to guidance by crowning can also be utilized for rope condition monitoring. Since all mechanical damages in the rope affect its internal stress distribution, the equilibrium position of the rope 1 resting on crowning changes if the rope 1 is damaged. This means that the rope condition can be monitored by following its lateral position on the crowned rope wheel 5. Should the rope 1 be displaced from the equilibrium position z, for example a distance d illustrated in FIG. 2, this may mean that a load bearing member of the rope 1 is damaged, for example. The damage causes a deviation in stress distribution at the damaged location of the rope 1, and this causes that the damaged location will have a different equilibrium position than the flawless locations of the rope 1. Therefore the damaged location of the rope 1 will be displaced by the crowning when it passes around the crowned rope wheel 5. Existence and/or the specific location of a damage in the rope 1 can be detected by analyzing lateral position data D gathered from the monitoring zone 4 located in proximity of the crowned rope wheel. After the location(s) of the rope 1 has/have passed away from the crowned rope wheel 5, the rope typically starts immediately to recover back to its normal equilibrium position z. Accordingly, a quite typical characteristic indicating rope damage is a peak-like deviation 10 that can be detected in the lateral position data D, such as the curve-type data D illustrated in FIG. 3. With the method, it is possible to detect several different damage modes. Damages detectable with the method may include practically any damages that cause deviations in stress distribution in the rope, these obviously including discontinuities in longitudinal direction, but also discontinuities in thickness- or width direction of the rope, such as delamination of components of the rope 1.

For the purpose of detection, the condition monitoring equipment 6 preferably comprises one or more detectors 6*a*. Said monitoring then preferably comprises detecting by one or more detectors 6*a* lateral positions of several successive rope locations of the rope 1 passing via the monitoring zone 4. Said detecting is preferably further such that it comprises measuring the lateral positions.

Preferably, said gathering comprises storing the lateral positions detected in said monitoring in a memory, such as in a memory chip or a hard drive. For this purpose the arrangement A can comprise a memory chip or a hard drive. Further for said analyzing and detecting characteristics in the lateral position data D indicating damaged rope 1, the arrangement A can comprise one or more processors, such as one or more microprocessors. They are preferably contained in a processing unit, such as a computer. The memory as well as the memory can be part of, or connected with the elevator control 100.

So as to facilitate steps of the further process, such as inspection of the damage by a service person or analysis after removal of the rope 1 from the elevator, the one or more actions comprises indicating in which location(s) of the rope characteristics in the lateral position data indicating damaged rope were detected.

The one or more actions preferably include one or more of the following:

- stopping the elevator; preventing further starts of the elevator;
- sending an alarm signal;
- sending a signal containing rope condition information;
- sending a signal indicating that service is needed;
- inspecting further the location(s) of the rope in which characteristics in the lateral position data indicating damaged rope were detected, said inspecting including preferably inspecting by a service person;
- replacing the rope with a new rope.

Said characteristics in the lateral position data indicating damaged rope preferably include a predefined deviation 10 in lateral position of the belt-shaped rope 1. The predefined deviation may be predefined to be a peak-like deviation. More specifically, the predefined deviation may be predefined to be a deviation of the lateral position of a location from the lateral positions of other locations in a predefined manner, such as by an amount exceeding a limit, said other locations including one or more locations on opposite sides of the location in question. Alternatively, or additionally, the predefined deviation may be predefined to be a deviation of the lateral position of a location from the lateral position(s) detected for the same location earlier.

The lateral position data D is preferably put in a form presenting the lateral positions of said rope locations as an amount of displacement from a specific default position d. Said lateral position data D is preferably in a curve form 9. Furthermore, it is preferable that said lateral position data D indicates the lateral positions of the rope locations as function of rope location, wherein the rope location is preferably presented in units of length such as meters or feet, but alternatively reference values could be used. As an alternative to said curve form, the lateral position data D could be in table form.

It is possible that all the aforementioned steps are performed during one single run or during several runs of the elevator. It is possible to benefit from historical information, if said lateral position data is gathered during plurality of elevator runs, such as two or more runs, wherein a run is a period delimited by start and stop of movement of the elevator car 2. In this case, the aforementioned characteristics preferably include that the aforementioned predefined deviation 10 is consistently, i.e. at least two times, detected in the same rope location.

It is also possible that all the aforementioned steps are performed periodically, such as after every 100 000 starts of the elevator.

Figure 4:
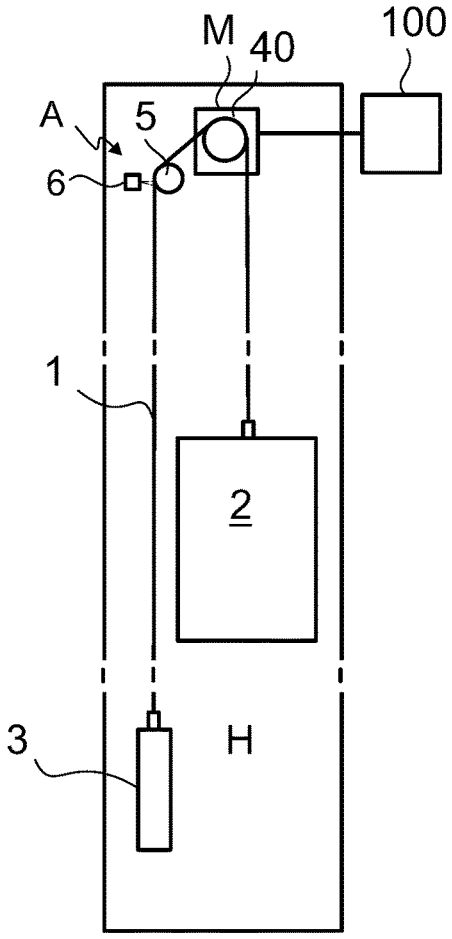
FIG. 4 illustrates an elevator comprising an arrangement for monitoring condition of a belt-shaped rope of an elevator implementing a method according to an embodiment.
Figure 5:
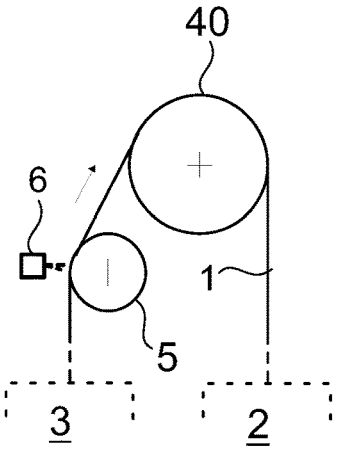
FIG. 5 illustrates layout of the arrangement of FIG. 4.
Figure 6:
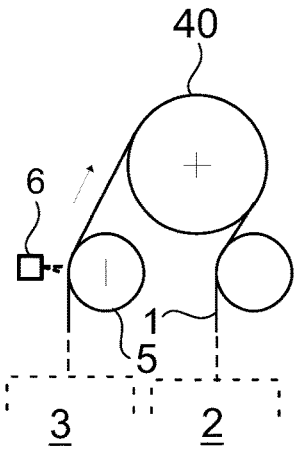
FIGS. 6 to 10 illustrate alternative layouts for the arrangement, wherein the aforementioned method can be implemented.

FIGS. 4 and 5 illustrates an elevator comprising an arrangement A for monitoring condition of a belt-shaped rope 1 of an elevator according to an embodiment. The arrangement A implements the method described above and is in accordance with what was described above referring to FIGS. 1-3. The rope 1 is connected with elevator units 2, 3 of the elevator. The elevator units include in this case an elevator car 2 and a counterweight 60, which are vertically moveable in a hoistway H and interconnected with the rope 1. The arrangement comprises at least one of said ropes 1, but preferably there are plurality of said ropes 1, the condition of each of them preferably being monitored in the corresponding way. The rope 1 is in this embodiment a suspension rope of the elevator. The arrangement comprises a rotatable crowned rope wheel 5 around which the belt-shaped rope 1 is arranged to turn, in particular resting against a crowned circumferential surface area a thereof as illustrated in FIG. 2 before. The arrangement further comprises a rope condition monitoring equipment 6, wherein the rope condition monitoring equipment 6 is configured to monitor during use of the elevator lateral positions of successive rope locations of a belt-shaped rope 1 which rope locations pass during use of the elevator passing via a monitoring zone 4 located in proximity of the crowned rope wheel 5, and to gather lateral position data of the belt-shaped rope 1, which lateral position data indicates lateral positions of several successive rope locations of the rope 1 based on detection(s) performed for the rope location in question when the rope location in question was at the monitoring zone 4; and to analyze the lateral position data; The arrangement A is further configured to detect characteristics in the lateral position data indicating damaged rope; and to trigger one or more actions if characteristics indicating damaged rope are detected.

The arrangement A is preferably further such that the rope condition monitoring equipment 6 comprises one or more detectors 6*a*, as illustrated in FIG. 1, for detecting lateral position of a rope location in the monitoring zone 4.

The monitoring zone 4 is most preferably located in proximity of a crowned rope wheel 5 such that it is within less than 2 meters distance, most preferably within less than 1 meters distance, as measured along the rope, from the crowned rope wheel 5. The free rope length L before the crowned rope wheel is preferably at least 2 meters, which is to ensure free lateral movement.

Preferably, the one or more detectors 6*a* comprises one or more contactless sensing devices, such as a light curtain or a camera. Preferably, the one or more contactless sensing devices comprises an optical sensing device.

In the illustrated embodiment, the rope section extending between the counterweight and the drive wheel is arranged to turn around the crowned wheel 5. Thus, tension of the rope entering the crowned rope wheel 5 is independent of car load. This eliminates possible effect of car load on the rope lateral position.

The elevator further comprises means M,100 for automatically moving the elevator units 2, 3. The drive means include in this case a motor M arranged to act on a drive wheel 40 engaging the rope 1 connected with the elevator units 2,3. The drive means further include an elevator control 100 for automatically controlling rotation of the motor M, whereby the movement of the car 2 is also made automatically controllable. The drive wheel as well as the crowned wheel 5 are in the embodiment of FIG. 4 mounted in proximity of the upper end of the hoistway H. In this case they are mounted inside the upper end of the hoistway H, but alternatively they could be mounted inside a space beside or above the upper end of the hoistway H. The drive wheel 40 can also be crowned for guiding the rope 1.

FIGS. 6 to 10 illustrate alternative layouts for the arrangement A, wherein the aforementioned method can be implemented. In the embodiment illustrated in FIG. 6, there are crowned rope wheels on both sides of the drive wheel 40. In the embodiment illustrated in FIG. 7, the crowned rope wheel 5 is the drive wheel 40 of the elevator. In the embodiments illustrated in FIGS. 8 and 9, the rope 1 is a compensation rope of the elevator. Thus, the crowned rope wheel 5 is positioned in the bottom end of the hoistway H and acts on the rope section hanging between the counterweight 3 and the car 2.

Figure 7:
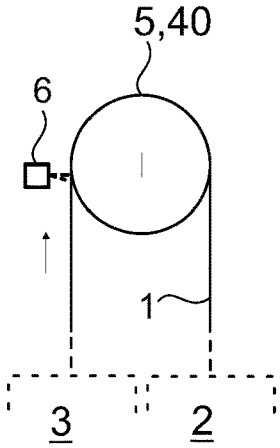
Figure 8:
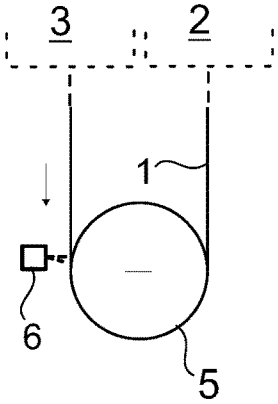
Figure 9:
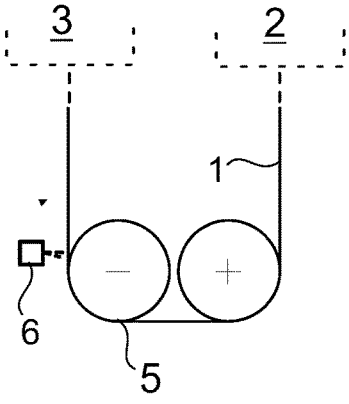
Figure 10:
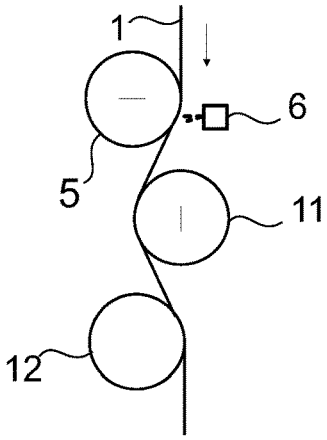

In the embodiment illustrated in FIG. 7, the crowned rope wheel 5 is a rope wheel of a rope wheel arrangement comprising plurality of rope wheels 5,11,12, which rope wheel arrangement does not substantially divert the direction of the rope. The arrangement comprises one or more rope wheels 11,12 guiding the rope such that the rope 1 passes along the crowned circumferential surface area of the crowned rope wheel 5 with contact length at least 110 mm long. The crowned rope wheel 5 acts on a rope section arriving at the rope wheel arrangement vertically departing from the rope wheel arrangement vertically. Thus, the condition monitoring arrangement A utilizing the crowned rope wheel 5 can be added into an existing elevator without affecting rope passage substantially.

When monitoring rope condition, rope running direction is preferably such that the tension F in the rope entering the crowned rope wheel 5 is independent of car load. This eliminates possible effect of car load on the rope lateral position.

In a preferred embodiments illustrated, both the crowned circumferential surface area a as well as the side of the rope resting against it are smooth, at least to a degree that lateral movement of the rope 1 along the crowned circumference area a of the rope wheel 5 is enabled.

Figure 11:
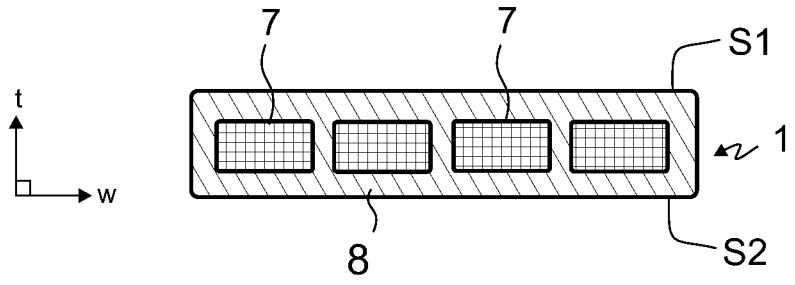
FIGS. 11 and 12 illustrate preferred details of the rope.
Figure 12:
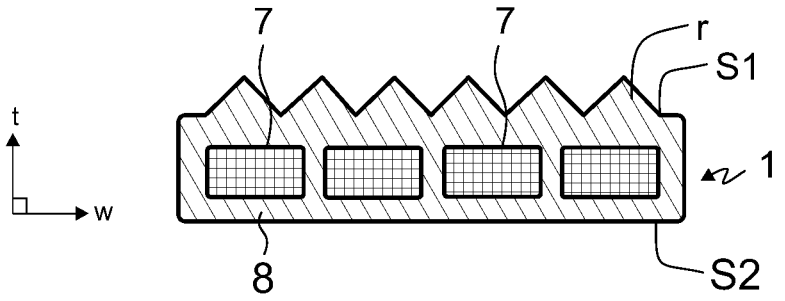

FIGS. 11 and 12 illustrate preferred alternative details of the belt-shaped elevator rope 1. Figures illustrate each a cross section of the rope 1. In the preferred embodiments shown, the rope 1 comprises the coating 8 made of polymer material and forming the outer surface of the rope 1. The rope 1 further comprises one or more load bearing members 7 embedded in said elastic coating 8 which one or more load bearing members 7 extend parallel to the longitudinal direction of the rope 1 unbroken throughout the length of the rope 1. In case there are plurality of the load bearing members 7, they are preferably adjacent each other in width direction of the rope 1 as illustrated. In the present case, there are four of said load bearing members embedded in said elastic coating 8, but the rope 1 could alternatively have any other number of load bearing members 7, such as only one load bearing member 7 wide in width direction of the rope 1, or any other number e.g. a number from 1 to 10.

With the coating, the rope is provided with a surface via which the rope can effectively engage frictionally with a drive wheel, for instance. Also, hereby the friction properties of the rope are adjustable to perform well in the intended use, for instance in terms of traction for transmitting force in longitudinal direction of the rope so as to move the rope with a drive wheel, but also to ensure friction sufficient for efficient guidance by the crowned shape of the rope wheel 5. Furthermore, the load bearing members 7 embedded therein are thus provided with protection. The coating 8 is preferably elastic, such as made of polyurethane. Elastic material, and particularly polyurethane provides the rope 1 good frictional properties and wear resistance. Polyurethane is in general well suitable for elevator use, but also materials such as rubber or equivalent elastic materials are suitable for the material of the coating 8. Said one or more load bearing members 7 is/are preferably, but not necessarily, made of composite material comprising reinforcing fibers f embedded in polymer matrix m, said reinforcing fibers preferably being carbon fibers. With this kind of structure, the rope 1 has properties advantageous in elevator use, such as weight and tensile stiffness in longitudinal direction. This makes the rope however relatively brittle and difficult to determine its condition. For this reason, the condition monitoring by using the lateral position data is particularly advantageous with this kind of rope. In particular, the condition monitoring arrangement A is able to detect delamination of fibres and matrix, but also failures in bonding between the load bearing members 7 and the coating 8. Preferred further details of the load bearing members 7 are described referring to FIGS. 13 and 14.

The rope 1 being belt-shaped provides that it is substantially larger in its width direction w than in its thickness direction t. The width/thickness ratio of the rope 1 is preferably at least 2 more preferably at least 4, or even more. In this way a large cross-sectional area for the rope is achieved, the bending capacity around the width-directional axis being favorable also with rigid materials of the load bearing member. Thereby, the rope 1 suits very well to be used in hoisting appliances, in particular in elevators, wherein the rope 1 needs to be guided around rope wheels. Also, it is preferable that the load bearing members 7 are wide. Accordingly, each of said one or more load bearing members 7 is preferably larger in its width direction w than in its thickness direction t of the rope 1. Particularly, the width/thickness ratio of each of said one or more load bearing members is preferably more than 2. Thereby, the bending resistance of the rope is small but the load bearing total cross sectional area is vast with minimal non-bearing areas.

The belt-shaped elevator rope 1 has opposite wide sides S1,S2 facing in thickness direction t of the rope 1. One of the wide sides S1,S2 is to be placed to rest against the crowned circumferential surface area a of the rope wheel 5, as illustrated in FIGS. 1 and 2. Preferably at least one of the sides S1,S2, namely the side placed to rest against the crowned circumferential surface area a of the rope wheel 5, is smooth for enabling lateral movement of the rope 1 along the crowned circumference area a of the rope wheel 5. Both said sides S1 and S2 can be smooth, as illustrated in FIG. 11, in which case either one of the sides S1 or S2 can be placed to rest against the crowned circumferential surface area a of the rope wheel 5. Alternatively, one S2 of the sides S1 or S2 can be smooth, while the opposite side S1 is contoured such as toothed or ribbed comprising a tooth-pattern or rib-pattern, as illustrated in FIG. 12. FIG. 12 illustrates particularly a cross section for the rope 1 when it has a rib-pattern. Said rib-pattern comprises elongated ribs and grooves extending parallel to the longitudinal direction I of the rope 1.

Figure 13:
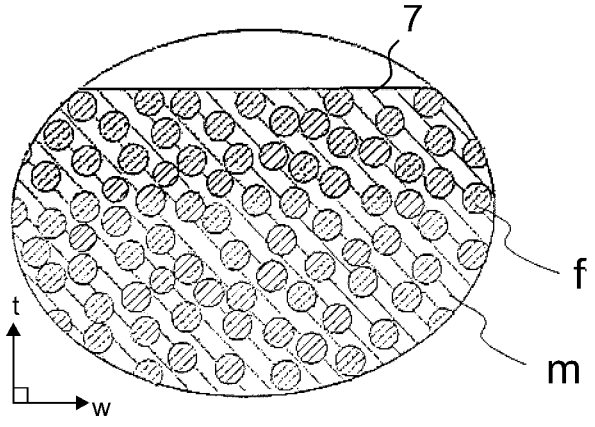
FIGS. 13 and 14 illustrate preferred details of the load bearing member of the rope.
Figure 14:
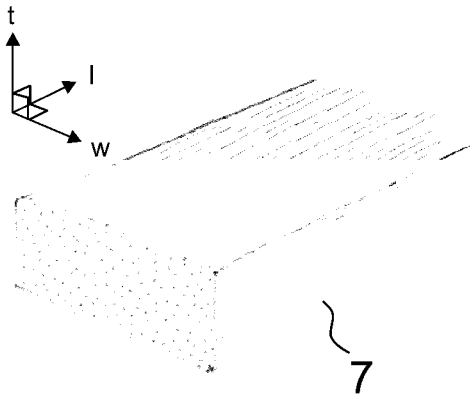

FIG. 13 illustrates a preferred inner structure for said load bearing member 7, showing inside the circle an enlarged view of the cross section of the load bearing member 7 close to the surface thereof, as viewed in the longitudinal direction I of the load bearing member 7. The parts of the load bearing member 7 not showed in FIG. 13 have a similar structure. FIG. 14 illustrates the load bearing member 7 three dimensionally. The load bearing member 7 is made of composite material comprising reinforcing fibers f embedded in polymer matrix m. The reinforcing fibers f are more specifically distributed substantially evenly in polymer matrix m and bound to each other by the polymer matrix. The load bearing member 7 formed is a solid elongated rod-like one-piece structure. Said reinforcing fibers f are most preferably carbon fibers, but alternatively they can be glass fibers, or possibly some other fibers. Preferably, substantially all the reinforcing fibers f of each load bearing member 7 are parallel with the longitudinal direction of the load bearing member 7. Thereby, the fibers f are also parallel with the longitudinal direction of the rope 1 as each load bearing member 7 is oriented parallel with the longitudinal direction of the rope 1. This is advantageous for the rigidity as well as behavior in bending. Owing to the parallel structure, the fibers in the rope 1 will be aligned with the force when the rope 1 is pulled, which ensures that the structure provides high tensile stiffness. The fibers f used in the preferred embodiments are accordingly substantially untwisted in relation to each other, which provides them said orientation parallel with the longitudinal direction of the rope 1. This is in contrast to the conventionally twisted elevator ropes, where the wires or fibers are strongly twisted and have normally a twisting angle from 15 up to 40 degrees, the fiber/wire bundles of these conventionally twisted elevator ropes thereby having the potential for transforming towards a straighter configuration under tension, which provides these ropes a high elongation under tension as well as leads to an unintegral structure. The reinforcing fibers f are preferably long continuous fibers in the longitudinal direction of the load bearing member 7, preferably continuing for the whole length of the load bearing member 7.

As mentioned, the reinforcing fibers f are preferably distributed in the aforementioned load bearing member 7 substantially evenly. The fibers f are then arranged so that the load bearing member 7 would be as homogeneous as possible in the transverse direction thereof. An advantage of the structure presented is that the matrix m surrounding the reinforcing fibers f keeps the interpositioning of the reinforcing fibers f substantially unchanged. It equalizes with its slight elasticity the distribution of force exerted on the fibers, reduces fiber-fiber contacts and internal wear of the rope, thus improving the service life of the rope 1. Owing to the even distribution, the fiber density in the cross-section of the load bearing member 7 is substantially constant. The composite matrix m, into which the individual fibers f are distributed, is most preferably made of epoxy, which has good adhesiveness to the reinforcement fibers f and which is known to behave advantageously with reinforcing fibers such as carbon fiber particularly. Alternatively, e.g. polyester or vinyl ester can be used, but any other suitable alternative materials can be used.

The matrix m has been applied on the fibers f such that a chemical bond exists between each individual reinforcing fiber f and the matrix m. Thereby a uniform structure is achieved. To improve the chemical adhesion of the reinforcing fiber to the matrix m, in particular to strengthen the chemical bond between the reinforcing fiber f and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer, such as said epoxy, as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance.

The reinforcing fibers f being in the polymer matrix means here that the individual reinforcing fibers f are bound to each other with a polymer matrix m. This has been done e.g. in the manufacturing phase by immersing them together in the fluid material of the polymer matrix which is thereafter solidified.

The reinforcing fibers f together with the matrix m form a uniform load bearing member, inside which no substantial abrasive relative movement occurs when the rope is bent. The individual reinforcing fibers f of the load bearing member 7 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers f can be pre-coated with material of the matrix m such that a coating of polymer material of said matrix is around each of them already before they are brought and bound together with the matrix material, e.g. before they are immersed in the fluid matrix material.

As above mentioned, the matrix m of the load bearing member 7 is most preferably hard in its material properties. A hard matrix m helps to support the reinforcing fibers f, especially when the rope bends, preventing buckling of the reinforcing fibers f of the bent rope, because the hard material supports the fibers f efficiently. To reduce the buckling and to facilitate a small bending radius of the load bearing member 7, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity (E) is over 2 GPa, most preferably over 2.5 GPa. In this case the module of elasticity E is preferably in the range 2.5-10 GPa, most preferably in the range 2.5-4.5 GPa. There are commercially available various material alternatives for the matrix m which can provide these material properties. Preferably over 50% proportion of the surface area of the cross-section of the load bearing member 7 is of the aforementioned reinforcing fiber, preferably such that 50%-80% proportion is of the aforementioned reinforcing fiber, more preferably such that 55%-70% proportion is of the aforementioned reinforcing fiber, and substantially all the remaining surface area is of polymer matrix m. Most preferably, this is carried out such that approx. 60% of the surface area is of reinforcing fiber and approx. 40% is of matrix material (preferably epoxy material). In this way a good longitudinal stiffness for the load bearing member 7 is achieved. As mentioned carbon fiber is the most preferred fiber to be used as said reinforcing fiber due to its excellent properties in hoisting appliances, particularly in elevators. However, this is not necessary as alternative fibers could be used, such as glass fiber, which has been found to be suitable for the hoisting ropes as well. The load bearing members 7 are preferably each completely non-metallic, i.e. made not to comprise metal.

In the illustrated embodiments, the load bearing members 7 are substantially rectangular and larger in width direction than thickness direction. However, this is not necessary as alternative shapes could be used. Likewise, it is not necessary that the number of the load bearing members is four which is used for the purpose of the example. The number of the load bearing members 7 can be greater or smaller. The number can be one, two or three for instance, in which cases it may be preferably to shape it/them wider than what is shown in Figures.

The rope 1 is furthermore such that the aforementioned load bearing member 7 or a plurality of load bearing members 7, comprised in the rope 1, together cover majority, preferably 70% or over, more preferably 75% or over, most preferably 80% or over, most preferably 85% or over, of the width of the cross-section of the rope 1 for essentially the whole length of the rope 1. Thus the supporting capacity of the rope 1 with respect to its total lateral dimensions is good, and the rope 1 does not need to be formed to be thick.

The contact length s between the rope 1 and the crowned rope wheel 5 is preferably at least 110 mm, which ensures that crowning works properly. The crowned rope wheel is preferably a stationary rope wheel, i.e. not mounted on the car 2 or counterweight 3. A solid base eliminates changes in wheel alignment through elevator lifetime. The condition monitoring is preferably not done during sway, or the rope 1 entering the crowned rope wheel 5 shall be protected against sway. This is to eliminate the effect of external disturbances on rope lateral position. As illustrated, the crowned rope wheel can be a non-drive rope wheel of the elevator, or alternatively the drive wheel of the elevator.

In the preferred embodiments, the advantageous structure for the belt-shaped rope 1 has been disclosed. However, the invention can be utilized with also other kind of belt-shaped ropes such as belt-shaped ropes having different materials. Also, the outer shape could be contoured otherwise than disclosed.

The belt-shaped rope 1 is arranged to turn around the crowned rope wheel 5 turning around an axis x extending in width-direction w of the rope 1. When referring to said lateral position it is meant position particularly in width direction w of the rope 1. The rope 1 being placed its wide side resting against the crowned rope wheel 5, this means the lateral position also equals the position in axial direction of the crowned rope wheel 5.

When referring to said successive rope locations it is meant locations the rope has and which are distributed successively along the length of the rope. The total number and frequency of the rope locations in the lateral position data depends on the resolution of the monitoring, in particular of the frequency of the detections performed for the rope, but also on the way in which the monitoring is performed. Basically the resolution may be regarded to be infinite in case the monitoring produces a continuous curve, and on the other hand a smaller when the monitoring produces detections only intermittently. The frequency of rope locations is preferably more than 0.5/meter.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. An arrangement for monitoring a condition of a belt-shaped rope of an elevator, which rope is connected with one or more elevator units of an elevator, the arrangement comprising;

a rotatable crowned rope wheel around which the belt-shaped rope is arranged to turn, wherein the belt-shaped rope has an equilibrium position relative to a width of a circumferential surface of the crowned rope wheel when passing around the crowned rope wheel during use of the elevator; and rope condition monitoring equipment, wherein the rope condition monitoring equipment is configured:

to monitor lateral positions of successive rope locations of a belt-shaped rope, the rope locations passing during use of the elevator via a monitoring zone located in proximity of the crowned rope wheel;

to gather lateral position data of the belt-shaped rope, the lateral position data indicating lateral positions of several successive rope locations of the rope with respect to the equilibrium position at the monitoring zone;

to analyze the lateral position data;

to detect characteristics in the lateral position data indicating damaged rope, wherein the detected characteristics include a predefined deviation of a lateral position of a location of the several successive rope locations, from lateral positions of other locations of the several successive rope locations, or from a lateral position of a same location detected earlier, by an amount exceeding a predefine limit; and to trigger one or more actions based on the detected characteristics indicating damaged rope.

2. The arrangement according to claim 1, wherein the rope condition monitoring equipment comprises one or more detectors for detecting lateral position of a rope location in the monitoring zone.

3. The arrangement according to claim 2, wherein the one or more detectors comprises one or more contactless sensing devices.

4. The arrangement according to claim 3, wherein the one or more contactless sensing devices are a light curtain or a camera.

5. The arrangement according to claim 1, wherein the rope comprises one or more load bearing members.

6. The arrangement according to claim 1, wherein the rope comprises a coating forming an outer surface of the rope.

7. The arrangement according to claim 1, wherein the rope comprises one or more load bearing members made of composite material comprising reinforcing fibers embedded in a polymer matrix.

8. The arrangement according to claim 7, wherein said reinforcing fibers are carbon fibers.

9. An elevator comprising:

a hoistway;

one or more elevator units moveable in the hoistway;

at least one belt-shaped rope connected with the one or more elevator units; and the arrangement for monitoring a condition of the at least one belt-shaped rope as defined in claim 1.

10. The arrangement according to claim 1, wherein the lateral position data is a curved form presenting lateral positions of said several successive rope locations of the rope as an amount of displacement from the equilibrium position at the monitoring zone, and wherein the rope condition monitoring equipment is configured to trigger said one or more actions indicating damaged rope only when the deviation of the lateral position of a location of the several successive rope locations, from the lateral positions of other locations of the several successive rope locations, or from the lateral position of the same location detected earlier, exceeds said predefine limit.

11. A method of using the arrangement according to claim 1 for monitoring the condition of the belt-shaped rope of the elevator, the method comprising the steps of:

monitoring lateral positions of successive rope locations, the rope locations passing during use of the elevator via a monitoring zone located in proximity of a crowned rope wheel around which the belt-shaped rope is arranged to turn;

gathering lateral position data of the belt-shaped rope, the lateral position data indicating lateral positions of several successive rope locations of the rope with respect to the equilibrium position at the monitoring zone;

analyzing the lateral position data;

detecting characteristics in the lateral position data indicating damaged rope; and triggering one or more predefined actions if characteristics indicating damaged rope are detected.

12. The method according to claim 11, wherein said monitoring comprises detecting lateral positions of several successive rope locations of the belt-shaped rope, which pass during use of the elevator via the monitoring zone.

13. The method according to claim 11, wherein said detecting comprises measuring the lateral positions.

14. The method according to claim 11, wherein the one or more actions comprises indicating in which location(s) of the rope characteristics in the lateral position data indicating damaged rope were detected.

15. The method according to claim 11, wherein the one or more predefined actions include one or more of the following:

stopping the elevator;

preventing further starts of the elevator;

sending an alarm signal;

sending a signal containing rope condition information;

sending a signal indicating that service is needed;

inspecting further the location(s) of the rope in which characteristics in the lateral position data indicating damaged rope were detected; and replacing the rope with a new rope.

16. The method according to claim 15, wherein the step of inspecting is performed by a service person.

17. The method according to claim 11, wherein said characteristics in the lateral position data indicating damaged rope include a predefined deviation in lateral position of the belt-shaped rope.

18. The method according to claim 11, wherein said deviation is a peak-like deviation.

19. The method according to claim 11, wherein said lateral position data is in a curve form.

20. The method according to claim 11, wherein said lateral position data is gathered during a single elevator run or during a plurality of elevator runs.

* * * * *